US010057952B2

(12) United States Patent
Chobot

(10) Patent No.: US 10,057,952 B2
(45) Date of Patent: Aug. 21, 2018

(54) LIGHTING APPARATUS USING A NON-LINEAR CURRENT SENSOR AND METHODS OF OPERATION THEREOF

(75) Inventor: Joseph Paul Chobot, Morrisville, NC (US)

(73) Assignee: Cree, Inc., Durham, NC (US)

( * ) Notice: Subject to any disclaimer, the term of this patent is extended or adjusted under 35 U.S.C. 154(b) by 1356 days.

(21) Appl. No.: 12/968,789

(22) Filed: Dec. 15, 2010

(65) Prior Publication Data

US 2012/0153844 A1 Jun. 21, 2012

(51) Int. Cl.
*H05B 33/08* (2006.01)
*H05B 37/02* (2006.01)

(52) U.S. Cl.
CPC ..... *H05B 33/0824* (2013.01); *H05B 33/083* (2013.01)

(58) Field of Classification Search
CPC ..... H05B 33/08; H05B 33/0866; H05B 33/0824; H05B 33/083; H05B 33/0851; H05B 33/0815; H05B 37/00; H05B 37/02; H05B 41/36
USPC ... 315/185 R, 192, 194, 224, 291, 294, 297, 315/306, 308
See application file for complete search history.

(56) References Cited

U.S. PATENT DOCUMENTS 7,656,371 B2 2/2010 Shimizu et al.
2005/0001562 A1* 1/2005 Pederson ..... H05B 33/0848 315/291
2007/0171146 A1* 7/2007 Lee ..... G09G 3/3406 345/39
2007/0257623 A1* 11/2007 Johnson et al. ..... 315/193
2008/0164827 A1 7/2008 Lys
2008/0290804 A1* 11/2008 Santo ..... H05B 33/0854 315/158
2009/0174343 A1* 7/2009 Lenz et al. ..... 315/292
2010/0109535 A1* 5/2010 Lin ..... H05B 33/0851 315/149
2010/0109557 A1* 5/2010 Bouchard ..... 315/294
(Continued)

FOREIGN PATENT DOCUMENTS

CN 101076737 A 11/2007
CN 101330787 A 12/2008
(Continued)

OTHER PUBLICATIONS

U.S. Appl. No. 12/704,730, filed Feb. 12, 2010, van de Ven et al.
(Continued)

*Primary Examiner* — Thai Pham
(74) *Attorney, Agent, or Firm* — Myers Bigel, P.A.

(57) ABSTRACT

A lighting apparatus includes a lighting circuit including at least one light-emitting device, e.g., a string of LEDs, and at least one current sense diode configured to generate a forward voltage responsive to a current passing through the at least one light-emitting device. The apparatus further includes a control circuit configured to control the lighting circuit responsive to the generated forward voltage. In some embodiments, the least one light-emitting device includes the at least one current sense diode. In some embodiments, the at least one current sense diode is connected in series with the at least one light-emitting device.

17 Claims, 16 Drawing Sheets

(56) References Cited

U.S. PATENT DOCUMENTS

| | | | | |
|---|---|---|---|---|
| 2010/0134018 | A1* | 6/2010 | Tziony | H05B 33/083 315/122 |
| 2011/0127919 | A1* | 6/2011 | Lin | H05B 33/083 315/185 R |
| 2012/0194073 | A1* | 8/2012 | Wang | H05B 33/0818 315/86 |

FOREIGN PATENT DOCUMENTS

| | | | |
|---|---|---|---|
| CN | 101370335 | A | 2/2009 |
| CN | 101473694 | A | 7/2009 |
| CN | 101534594 | A | 9/2009 |
| CN | 101605416 | A | 12/2009 |
| WO | WO 02/056642 | A1 | 7/2002 |

OTHER PUBLICATIONS

International Search Report Corresponding to International Application No. PCT/US2011/060706; dated Mar. 9, 2012; 15 pages.
Chinese First Office Action Corresponding to Application No. 201180065280.9; dated Oct. 10, 2014; Foreign Text, 16 Pages, English Translation Thereof, 6 Pages.
Chinese Second Office Action Corresponding to Application No. 201180065280.9; dated Aug. 14, 2015; Foreign Text, 20 Pages, English Translation Thereof, 6 Pages.

* cited by examiner

LIGHTING APPARATUS USING A NON-LINEAR CURRENT SENSOR AND METHODS OF OPERATION THEREOF

FIELD

The inventive subject matter relates to lighting apparatus and methods of operation thereof and, more particularly, to apparatus and methods for control of lighting apparatus.

BACKGROUND

Solid state lighting devices are used for a number of lighting applications. For example, solid state lighting panels including arrays of solid state light emitting devices have been used as direct illumination sources, for example, in architectural and/or accent lighting. A solid state light emitting device may include, for example, a packaged light emitting device including one or more light emitting diodes (LEDs). Inorganic LEDs typically include semiconductor layers forming p-n junctions. Organic LEDs (OLEDs), which include organic light emission layers, are another type of solid state light emitting device. Typically, a solid state light emitting device generates light through the recombination of electronic carriers, i.e. electrons and holes, in a light emitting layer or region.

In many solid-state lighting applications, current is driven through an arrangement of LEDs to obtain a certain light output. This current is typically sensed to provide feedback to a controller that controls the level of illumination and/or color point. FIG. 1 illustrates a conventional technique for controlling current through one or more LEDs 110 in a lighting apparatus 100. A current sense resistor 120 is connected in series with the one or more LEDs 110. A voltage $V_{sense}$ developed across the current sense resistor 120 is provided to a control circuit 140, which uses the voltage $V_{sense}$ as a current feedback signal to control a transistor 130 connected in series with the one or more LEDs 110.

Current sense resistors may also be used in color point control applications. The color rendering index (CRI) of a light source is an objective measure of the ability of the light generated by the source to accurately illuminate a broad range of colors. The color rendering index ranges from essentially zero for monochromatic sources to nearly 100 for incandescent sources. Light generated from a phosphor-based solid state light source may have a relatively low color rendering index.

It is often desirable to provide a lighting source that generates a white light having a high color rendering index, so that objects and/or display screens illuminated by the lighting panel may appear more natural. Accordingly, to improve CRI, red light may be added to the white light, for example, by adding red emitting phosphor and/or red emitting devices to the apparatus. Other lighting sources may include red, green and blue light emitting devices. When red, green and blue light emitting devices are energized simultaneously, the resulting combined light may appear white, or nearly white, depending on the relative intensities of the red, green and blue sources.

In some applications, the color point of an LED lighting apparatus may be controlled by controlling currents flowing through different color LEDs of the apparatus. For example, U.S. patent application Ser. No. 12/704,730, entitled "SOLID STATE LIGHTING APPARATUS WITH COMPENSATION BYPASS CIRCUITS AND METHODS OF OPERATION THEREOF," filed Feb. 12, 2010, describes bypass circuits configured to selectively bypass current around light emitting devices of a serially-connected string of light emitting devices to achieve, for example, color point control. Such bypass circuits may operate responsive to a voltage developed across a current sense resistor connected in series with the string of light emitting devices, such that a desired color point may be maintained in response to, for example, variations in string current caused by a dimming circuit.

SUMMARY

A lighting apparatus according to some embodiments of the inventive subject matter includes a lighting circuit including at least one light-emitting device and at least one current sense diode configured to generate a forward voltage responsive to a current passing through the at least one light-emitting device. The apparatus further includes a control circuit configured to control the lighting circuit responsive to the generated forward voltage. In some embodiments, the least one light-emitting device includes the at least one current sense diode.

In further embodiments, the lighting circuit includes a string of serially connected light emitting devices and the at least one current sense diode is connected in series with serially connected light emitting devices. In some embodiments, the control circuit may be configured to control a current passing through the string of serially connected light emitting devices responsive to the sensed forward voltage. In some embodiments, the control circuit may be configured to control a bypass current around at least one light emitting device of the string of serially connected light emitting devices responsive to the sensed forward voltage.

According to further embodiments, the lighting circuit may include a first string of serially connected light emitting devices and a second string of serially connected light emitting devices, and the current sense diode may be connected in series with the first string of serially connected light emitting devices. The control circuit may be configured to control a current through the second string of serially connected light emitting devices responsive to the sensed forward voltage.

In additional embodiments, the apparatus further includes a temperature sensor configured to generate a temperature sense signal. The control circuit may be configured to control the lighting apparatus responsive to the forward voltage and the temperature sense signal.

According to some embodiments, the at least one current sense diode includes at least one LED. The lighting circuit may include a string of serially connected LEDs and the at least one current sense diode may be connected in series with the string of serially connected LEDs. In some embodiments, the at least one current sense diode may be an LED of the string of serially connected LEDs. In some embodiments, the control circuit may be configured to control a current passing through the string of serially connected LEDs responsive to the sensed forward voltage. In some embodiments, the control circuit may be configured to control a bypass current around at least one LED of the string of serially connected LEDs responsive to the sensed forward voltage.

In additional embodiments, the lighting circuit may include a first string of serially connected LEDs and a second string of serially connected LEDs. The current sense diode may include at least one LED of the first string of serially connected LEDs. The control circuit may be configured to control a current through the second string of serially connected LEDs responsive to the sensed forward voltage. The first and second strings of serially connected LEDS may include LEDs of different colors.

According to further embodiments of the inventive subject matter, a lighting apparatus includes at least one string of serially connected LEDs and at least one current sense diode configured to generate a forward voltage responsive to a current passing through the at least one string of serially connected LEDs. The apparatus further includes a control circuit configured to sense the forward voltage and to control the at least one string of LEDs responsive to the sensed forward voltage. The at least one current sense diode may include at least one LED of the string of serially connected LEDs.

In some embodiments, the control circuit may be configured to control a current passing through the string of serially connected LEDs responsive to the sensed forward voltage. In further embodiments, the control circuit may be configured to control a bypass current around at least one LED of the string of serially connected LEDs responsive to the sensed forward voltage.

In still further embodiments, the at least one string of serially connected LEDs may include a first string of serially connected LEDs and a second string of serially connected LEDs. The current sense diode may be connected in series with the first string of serially connected LEDs and the control circuit may be configured to control a current through the second string of serially connected LEDs responsive to the sensed forward voltage. The first and second strings of serially connected LEDS may include LEDs of different colors.

In additional embodiments of the inventive subject matter, a lighting apparatus includes a lighting circuit including at least one light-emitting device. The apparatus further includes a non-linear current sensor configured to generate a voltage representative of a current passing through the at least one light-emitting device and a control circuit configured to control the lighting circuit responsive to the generated voltage. The current may have a substantially exponential relationship the generated voltage. For example, the non-linear current sensor may include a diode and the voltage may be a forward voltage across the diode.

In some method embodiments, a lighting circuit including at least one light-emitting device is controlled. A forward voltage is generated across at least one current sense diode responsive to a current passing through the at least one light-emitting device. The forward voltage is sensed and the lighting circuit is controlled responsive to the sensed forward voltage. The at least one light-emitting device may include the at least one current sense diode. The at least one current sense diode may include at least one LED. For example, the lighting circuit may include a string of serially connected LEDs and the at least one current sense diode may be connected in series with the string of serially connected LEDs and/or may include at least one of the LEDs.

BRIEF DESCRIPTION OF THE DRAWINGS

The accompanying drawings, which are included to provide a further understanding of the inventive subject matter and are incorporated in and constitute a part of this application, illustrate certain embodiment(s) of the inventive subject matter.

Figure 1:
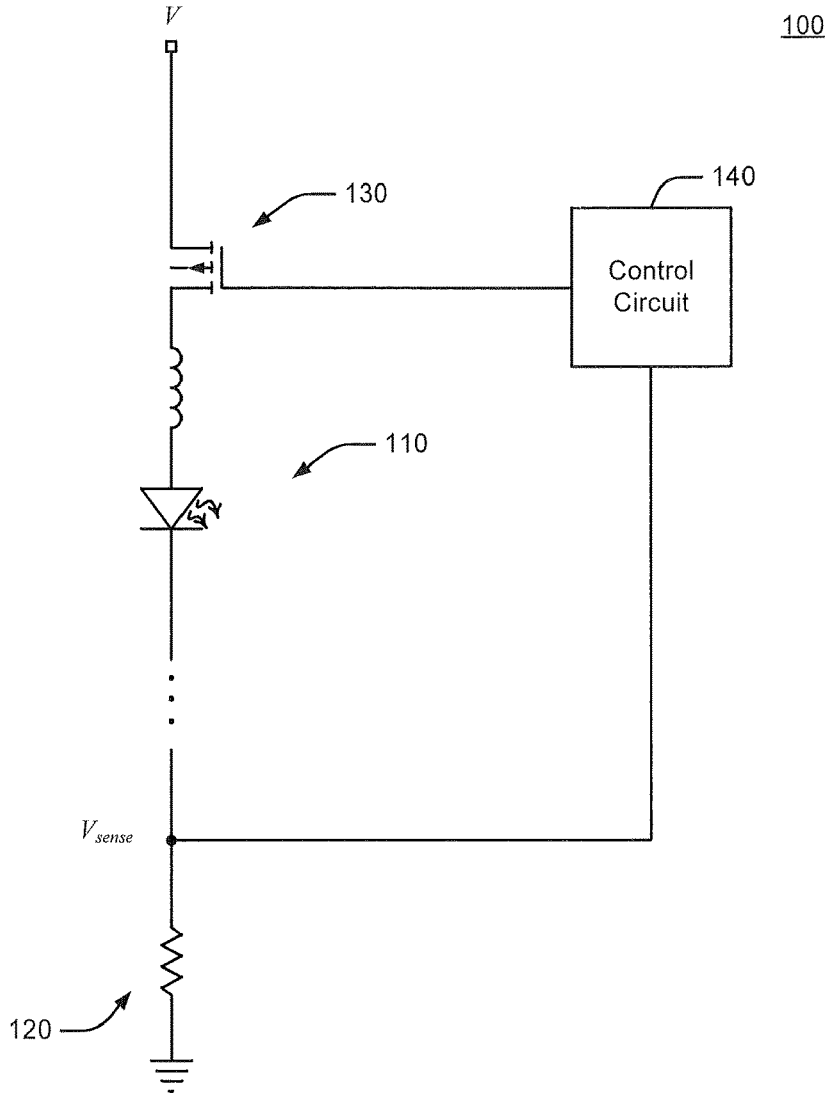
FIGURE 1 Prior Art
FIG. 1 illustrates a conventional control technique for a lighting apparatus.

FIG. illustrates lighting apparatus and calibration apparatus therefore according to further embodiments of the inventive subject matter.

DETAILED DESCRIPTION OF EMBODIMENTS

Embodiments of the inventive subject matter now will be described more fully hereinafter with reference to the accompanying drawings, in which embodiments of the inventive subject matter are shown. This inventive subject matter may, however, be embodied in many different forms and should not be construed as limited to the embodiments set forth herein. Rather, these embodiments are provided so that this disclosure will be thorough and complete, and will fully convey the scope of the inventive subject matter to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the inventive subject matter. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item.

Figure 2A:
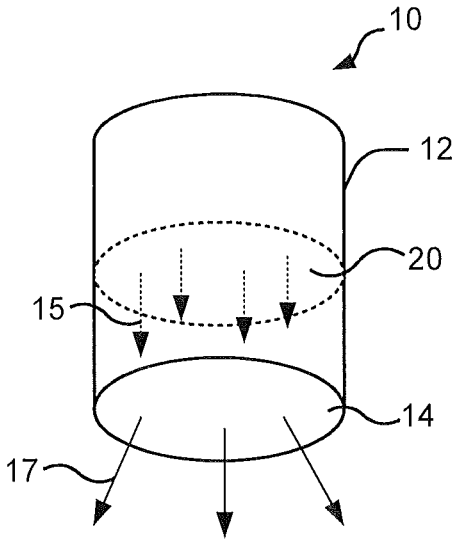
FIGS. 2A and 2B illustrate a solid state lighting apparatus in accordance with some embodiments of the inventive subject matter.
Figure 2B:
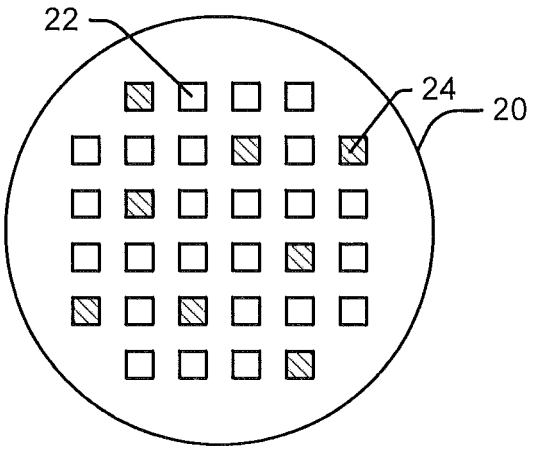

FIGS. 2A and 2B illustrate a lighting apparatus 10 in which to some embodiments of the inventive subject matter may be incorporated. The lighting apparatus 10 shown in FIGS. 2A and 2B is a "can" lighting fixture that may be suitable for use in general illumination applications as a down light or spot light. However, it will be appreciated that a lighting apparatus according to some embodiments may have a different form factor. For example, a lighting apparatus according to some embodiments can have the shape of a conventional light bulb, a pan or tray light, an automotive headlamp, or any other suitable form.

The lighting apparatus 10 generally includes a can shaped outer housing 12 in which a lighting panel 20 is arranged. In the embodiments illustrated in FIGS. 21A and 2B, the lighting panel 20 has a generally circular shape so as to fit within an interior of the cylindrical housing 12. Light is generated by solid state lighting devices (LEDs) 22, 24, which are mounted on the lighting panel 20, and which are arranged to emit light 15 towards a diffusing lens 14 mounted at the end of the housing 12. Diffused light 17 is emitted through the lens 14. In some embodiments, the lens 14 may not diffuse the emitted light 15, but may redirect and/or focus the emitted light 15 in a desired near-field or far-field pattern.

Still referring to FIGS. 2A and 2B, the solid-state lighting apparatus 10 may include a plurality of first LEDs 22 and a plurality of second LEDs 24. In some embodiments, the plurality of first LEDs 22 may include white emitting, or near white emitting, light emitting devices. The plurality of second LEDs 24 may include light emitting devices that emit light having a different dominant wavelength from the first LEDs 22, so that combined light emitted by the first LEDs 22 and the second LEDs 24 may have a desired color and/or spectral content. For example, the combined light emitted by the plurality of first LEDs 22 and the plurality of second LEDs 24 may be warm white light that has a high color rendering index.

The chromaticity of a particular light source may be referred to as the "color point" of the source. For a white light source, the chromaticity may be referred to as the "white point" of the source. The white point of a white light source may fall along a locus of chromaticity points corresponding to the color of light emitted by a black-body radiator heated to a given temperature. Accordingly, a white point may be identified by a correlated color temperature (CCT) of the light source, which is the temperature at which the heated black-body radiator matches the hue of the light source. White light typically has a CCT of between about 2500K and 8000K. White light with a CCT of 2500K has a reddish color, white light with a CCT of 4000K has a yellowish color, and while light with a CCT of 8000K is bluish in color.

"Warm white" generally refers to white light that has a CCT between about 3000 and 3500° K. In particular, warm white light may have wavelength components in the red region of the spectrum, and may appear yellowish to an observer. Incandescent lamps are typically warm white light. Therefore, a solid state lighting device that provides warm white light can cause illuminated objects to have a more natural color. For illumination applications, it is therefore desirable to provide a warm white light. As used herein, white light refers to light having a color point that is within 7 MacAdam step ellipses of the black body locus or otherwise falls within the ANSI C78-377 standard.

In order to achieve warm white emission, conventional packaged LEDs include either a single component orange phosphor in combination with a blue LED or a mixture of yellow/green and orange/red phosphors in combination with a blue LED. However, using a single component orange phosphor can result in a low CRI as a result of the absence of greenish and reddish hues. On the other hand, red phosphors are typically much less efficient than yellow phosphors. Therefore, the addition of red phosphor in yellow phosphor can reduce the efficiency of the package, which can result in poor luminous efficacy. Luminous efficacy is a measure of the proportion of the energy supplied to a lamp that is converted into light energy. It is calculated by dividing the lamp's luminous flux, measured in lumens, by the power consumption, measured in watts.

Warm white light can also be generated by combining non-white light with red light as described in U.S. Pat. No. 7,213,940, entitled "LIGHTING DEVICE AND LIGHTING METHOD," which is assigned to the assignee of the inventive subject matter, and the disclosure of which is incorporated herein by reference. As described therein, a lighting device may include first and second groups of solid state light emitters, which emit light having dominant wavelength in ranges of from 430 nm to 480 nm and from 600 nm to 630 nm, respectively, and a first group of phosphors which emit light having dominant wavelength in the range of from 555 nm to 585 nm. A combination of light exiting the lighting device which was emitted by the first group of emitters, and light exiting the lighting device which was emitted by the first group of phosphors produces a sub-mixture of light having x, y color coordinates within a defined area on a 1931 CIE Chromaticity Diagram that is referred to herein as "blue-shifted yellow" or "BSY." Such non-white light may, when combined with light having a dominant wavelength from 600 nm to 630 nm, produce warm white light.

Blue and/or green LEDs used in a lighting apparatus according to some embodiments may be InGaN-based blue and/or green LED chips available from Cree, Inc., the assignee of the inventive subject matter. Red LEDs used in the lighting apparatus may be, for example, AlInGaP LED chips available from Epistar, Osram and others.

In some embodiments, the LEDs 22, 24 may have a square or rectangular periphery with an edge length of about 900 μm or greater (i.e. so-called "power chips." However, in other embodiments, the LED chips 22, 24 may have an edge length of 500 μm or less (i.e. so-called "small chips"). In particular, small LED chips may operate with better electrical conversion efficiency than power chips. For example, green LED chips with a maximum edge dimension less than 500 microns and as small as 260 microns, commonly have a higher electrical conversion efficiency than 900 micron chips, and are known to typically produce 55 lumens of luminous flux per Watt of dissipated electrical power and as much as 90 lumens of luminous flux per Watt of dissipated electrical power.

The LEDs 22 in the lighting apparatus 10 may include white/BSY emitting LEDs, while the LEDs 24 in the lighting apparatus may emit red light. Alternatively or additionally, the LEDs 22 may be from one color bin of white LEDs and the LEDs 24 may be from a different color bin of white LEDs. The LEDs 22, 24 in the lighting apparatus 10 may be electrically interconnected in one or more series strings, as in embodiments of the inventive subject matter described below. While two different types of LEDs are illustrated, other numbers of different types of LEDs may also be utilized. For example, red, green and blue (RGB) LEDs, RGB and cyan, RGB and white, or other combinations may be utilized.

Some embodiments of the inventive subject matter arise from a discovery that non-linear current sensors may be advantageously used to control a lighting circuit, such as a string of LEDs. According to some embodiments, a non-linear, low-dissipation current sensor for lighting circuits may take the form of one or more diodes, which may have characteristics that are particularly suitable for controlling LED lighting devices. In some embodiments, the current sensing diode(s) may be one of the illuminating LEDs of the lighting apparatus.

A color of light produced by combining two or more different colors of LEDs may drift with variations in current passing through the LEDs. For example, if a lighting apparatus containing one or more strings of LEDs of different colors is dimmed by reducing the current flowing therethrough, different light output vs. current characteristics of the different color LEDs may cause a variation in the color point of the apparatus. Such variation may become problematic at low intensities, as the human eye is generally more sensitive to small variations at lower intensity levels.

A voltage-current (V-I) curve of an ideal diode may be given by:

$$I=I_S e^{V/V_T}, \tag{1}$$

where $I_S$ is the diode's reverse saturation current, V is the forward voltage across the diode and $V_T$ is the thermal voltage of the diode. The voltage across the diode can be expressed as a logarithmic function of the current I through the diode:

$$V=V_T \ln(I/I_S). \tag{2}$$

Some embodiments of the inventive subject matter may take advantage of this characteristic by using a diode as a non-linear current sensor that provides a substantially logarithmic current feedback signal that provides different gains at different current levels. As the thermal voltage $V_T$ of a diode may vary with temperature, some embodiments may provide more consistently effectively logarithmic feedback over a range of temperatures by compensating for temperature responsive to a temperature sense signal. In some embodiments, compensation for non-ideal diode behavior arising from, for example, leakage current and series resistance, may also be provided. In some embodiments, for example, a microcontroller may implement a lookup table that provides temperature and other compensation and/or a response function (e.g. a polynomial) that includes parameters that account for temperature and deviation of diode behavior from ideal logarithmic performance. Such lookup tables and/or response parameters may be generated, for example, in a calibration procedure.

Such a compensation function may be, for example, a linear model based on a datasheet value for change in forward voltage of a current sensing diode with temperature. Higher order models may also be used. For example, a bicubic surface polynomial or Bezier patch might be used for a compensation and/or response function. Such models may be used, for example, to generate an explicit representation of current or to generate a control signal that implicitly includes temperature-compensated current feedback information. For example, temperature and current data may be fed into such a function and used to generate, for example, a duty cycle command for a PWM circuit that controls current through a string of LEDs. Such models may be generated, for example, by generating data while operating the controlled lighting apparatus over temperature, current and dimming ranges and using a linear regression to determine model parameters, e.g., polynomial coefficients.

Figure 3:
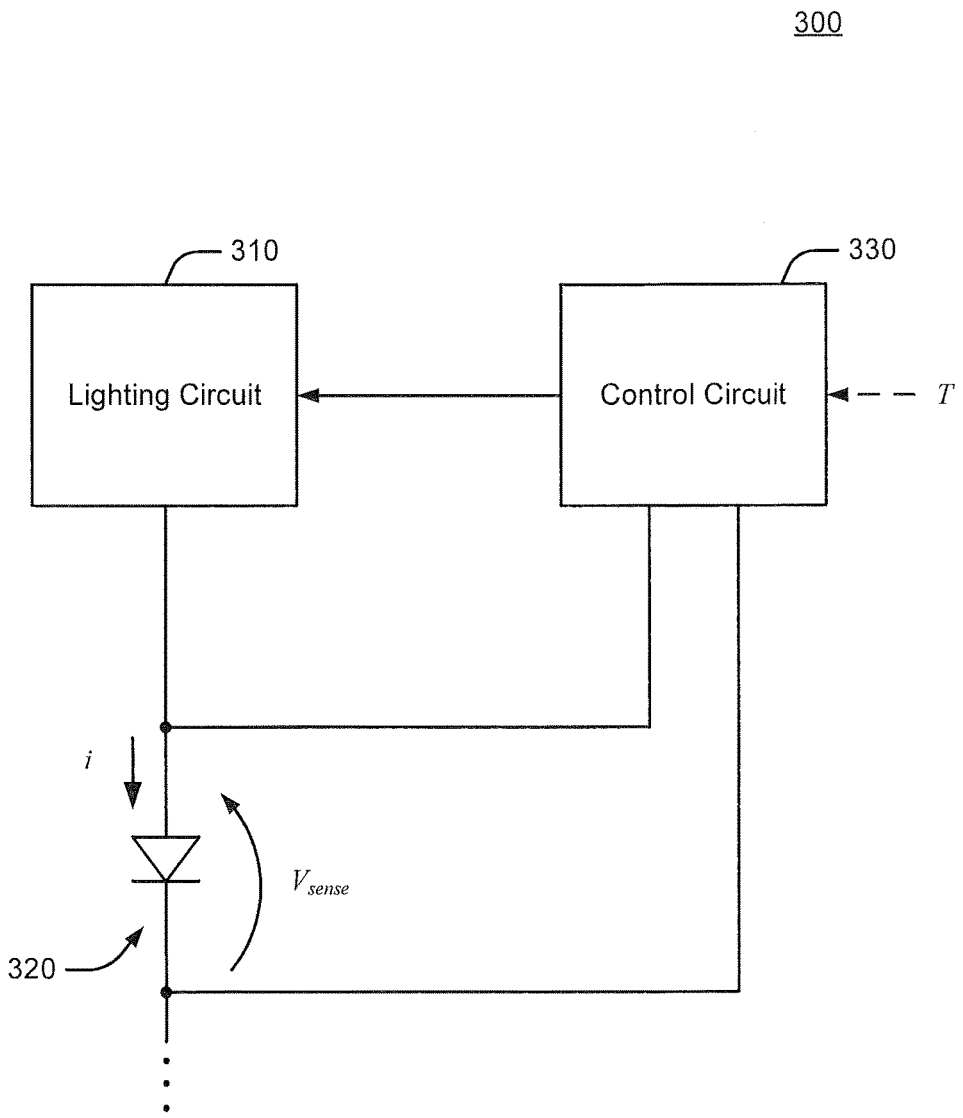
FIG. 3 illustrates a lighting apparatus with a non-linear diode current sensor according to some embodiments of the inventive subject matter.

As illustrated in FIG. 3, in some embodiments, a lighting circuit 310 may include at least one light emitting device, such as an LED. A current sense diode 320 may be configured to generate a forward voltage $V_{sense}$ responsive to a current i passing through the at least one light-emitting device. A control circuit 330 may be configured to control the lighting circuit 310 responsive to the generated forward voltage $V_{sense}$. The control circuit 330 may be further configured to control the lighting circuit 310 responsive to a temperature signal T, which may compensate for temperature-induced variations in the forward voltage $V_{sense}$. It will be appreciated that the current sense diode 320 generally may include any of a number of different types of diodes, both light-emitting and non-light-emitting, as well as other types of non-linear current sensing devices that have similar properties, such as transistor junctions.

Figure 4:
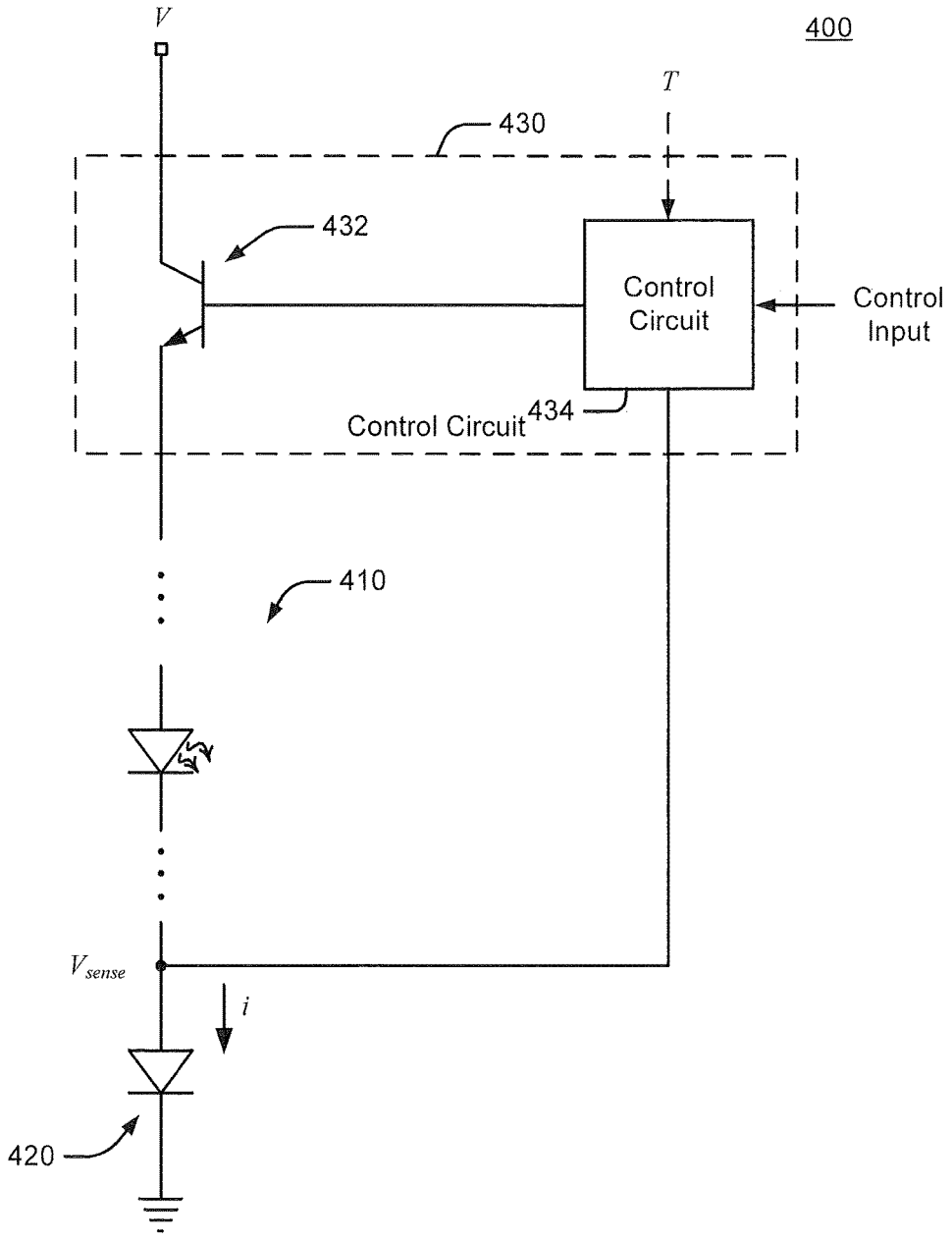
FIG. 4 illustrates a lighting apparatus with variable resistance current control and non-linear current feedback according to some embodiments of the inventive subject matter.

In some embodiments, a current sensing diode may be used to sense a current passing through a string of LEDs and used to control a current though the string. For example, as illustrated in FIG. 4, a current sense diode 420 may be connected in series with a string 410 of LEDs that is connected to a power supply having a voltage V. A forward voltage $V_{sense}$ developed across the current sense diode 420 in response to a current i through the string 410 may be used as a feedback signal to a string current control circuit 430, here shown as including a transistor 432 and a control circuit 434 that drives a base terminal of the transistor 432. The control circuit 434 may, for example, compare the current feedback signal $V_{sense}$ to a control input and generate the drive signal for the transistor 432 based on the comparison. In this manner, the current i may track the control input, which may represent a desired current level through the string 410. As also shown, the control circuit 434 may also operate responsive to a temperature sense signal T to enable the control circuit 434 to compensate for a temperature dependency of the forward voltage $V_{sense}$.

Figure 5:
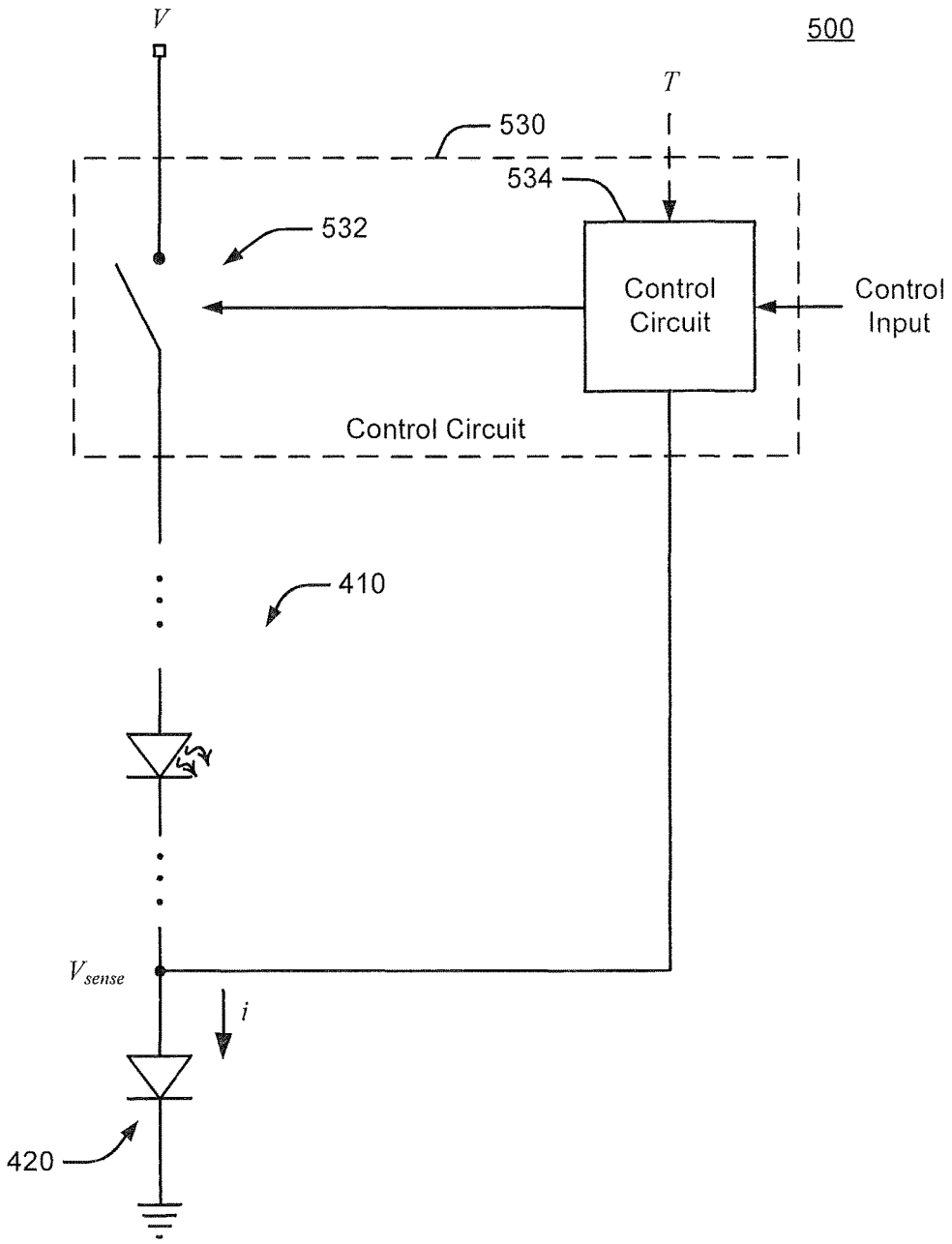
FIG. 5 illustrates a lighting apparatus with pulse-width-modulated (PWM) current control and non-linear current feedback according to some embodiments of the inventive subject matter.

It will be appreciated that the current sense diode 420 may be one or more LEDs of the LED string 410, one or more non-light emitting diodes or a combination thereof. The current sense diode 420 could also be connected in a different serial arrangement, for example, the current sense diode 420 could be connected in the middle of the string 410 and a differential voltage across the current sense diode 420 could be provided to the control circuit 430. Other current control arrangements may also be used. For example, as shown in FIG. 5, in a lighting apparatus 500, the current feedback voltage $V_{sense}$ could be provided to a pulse width modulated (PWM) control circuit 530 including a switch 532 (e.g., an FET or other transistor) that is turned on and off by a control circuit 534 responsive to comparison of a control input to the current feedback voltage $V_{sense}$. The control circuit 534 may also be configured to provide temperature compensation responsive to a temperature sense signal T.

Figure 6:
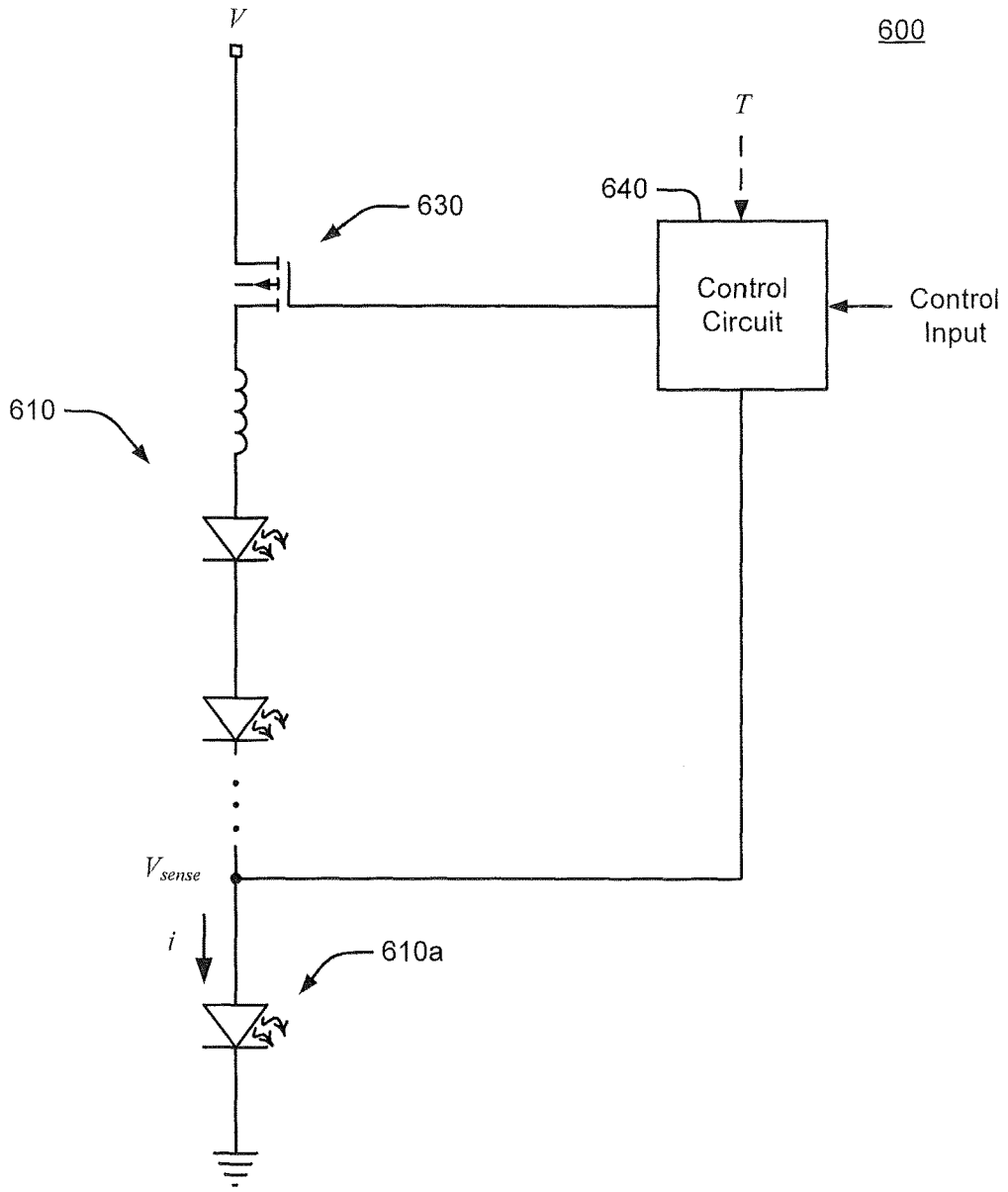
FIG. 6 illustrates a lighting apparatus with current feedback from an LED according to some embodiments of the inventive subject matter.

As shown in FIG. 6, a lighting apparatus 600 according to some embodiments of the inventive subject matter may include a string 610 of serially-connected LEDs. One LED 610*a* of the string 610 may be used as a current sensor, generating a forward voltage $V_{sense}$ that is fed back to a control circuit 640 that drives a transistor 630 connected in series with the LED string 610 using a PWM gate drive signal. The control circuit 640 may act to control the current i through the string 610 such that it conforms to a control input provided to the control circuit 640, for example, a control input signal representative of a desired level of illumination of the string 610. As illustrated, the control circuit 640 may also perform temperature compensation for the temperature variation of the current sensing LED 610*a* responsive to a temperature sense signal T.

Figure 7:
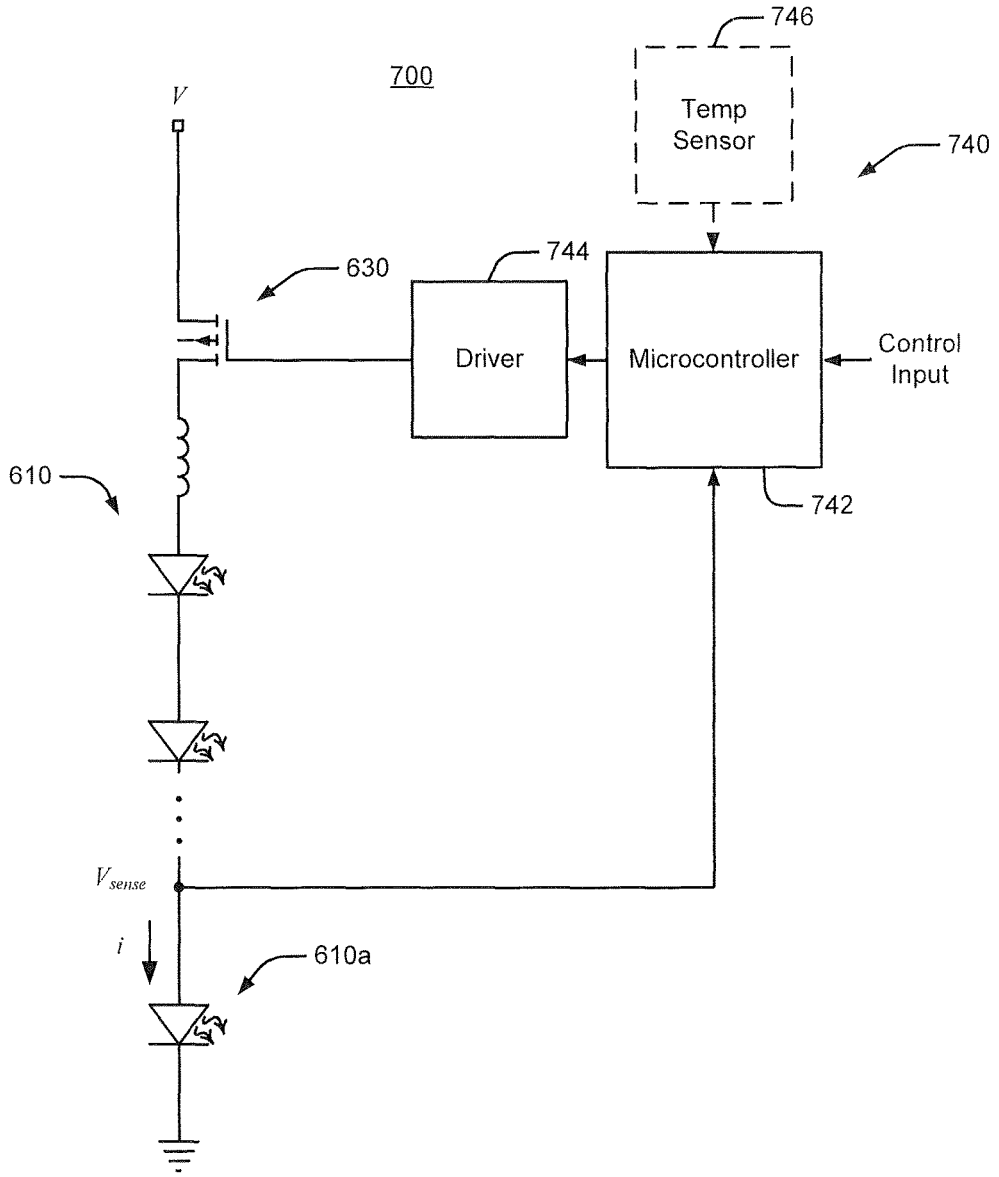
FIG. 7 illustrates a lighting apparatus with microcontroller-based current control and non-linear current feedback according to some embodiments of the inventive subject matter.

The control circuit 640 may be implemented using any of a variety of digital and/or analog control circuits. For example, as shown in FIG. 7, a control circuit 740 of a lighting apparatus 700 may include a microcontroller 742 that is configured operate responsive to a control input and the current feedback signal $V_{sense}$. The microcontroller 742 may include, in addition to a microprocessor, circuitry for implementing PWM control circuits, including analog to digital converter circuitry for sampling the current feedback signal $V_{sense}$ (and, optionally, a temperature sense signal provided by a temperature sensor 746), as well as output circuitry for producing a PWM signal that may be used to drive the transistor 630 directly or through an intermediate driver circuit 744. It will be appreciated that sampling, signal conversion and other functions could also be performed by peripheral circuitry that interoperates with a microcontroller, microprocessor or similar control circuitry.

Figure 8:
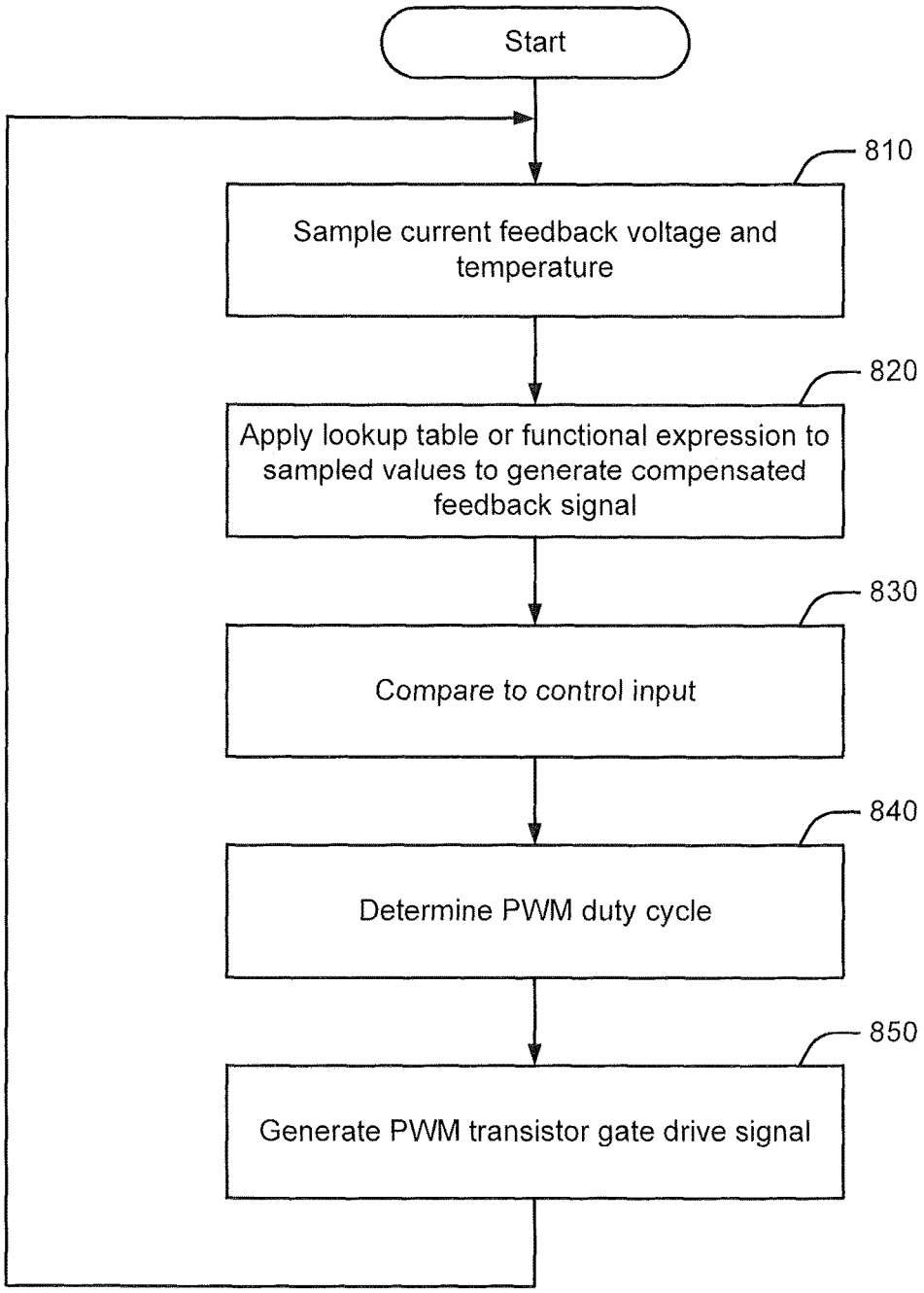
FIG. 8 is a flowchart illustrating control operations of the lighting apparatus of FIG. 7 according to some embodiments of the inventive subject matter.

The microcontroller 742 may be programmed to perform temperature compensation for the current feedback signal $V_{sense}$. For example, as shown in FIG. 8, the microcontroller 754 may sample and convert the current feedback signal $V_{sense}$ and a voltage generated by the temperature sensor 756 to digital values (block 810). The microcontroller 742 may process these digital current feedback and temperature values to generate a compensated current feedback value for comparison to the control input (blocks 820, 830). For example, the digital current feedback and temperature values may be input into a polynomial formula that provides temperature compensation as well as correction for non-idealities, e.g., non-ideal logarithmic voltage vs. current behavior, in the performance of the diode current sensor. Such an expression may include parameters, e.g., polynomial coefficients, which may be derived from calibration operations performed on the apparatus 700. In some embodiments, the microcontroller 742 may use the current feedback and temperature values to reference a lookup table that provides a similar compensation for temperature and/or non-ideal diode behavior. The PWM signal for driving the transistor 630 is then generated based on a comparison of the control input and the compensated current feedback signal (blocks 840, 850). It will be understood that the microcontroller 742 may also be programmed to implement various additional control loop compensation elements, such as filters and gains.

Figure 9:
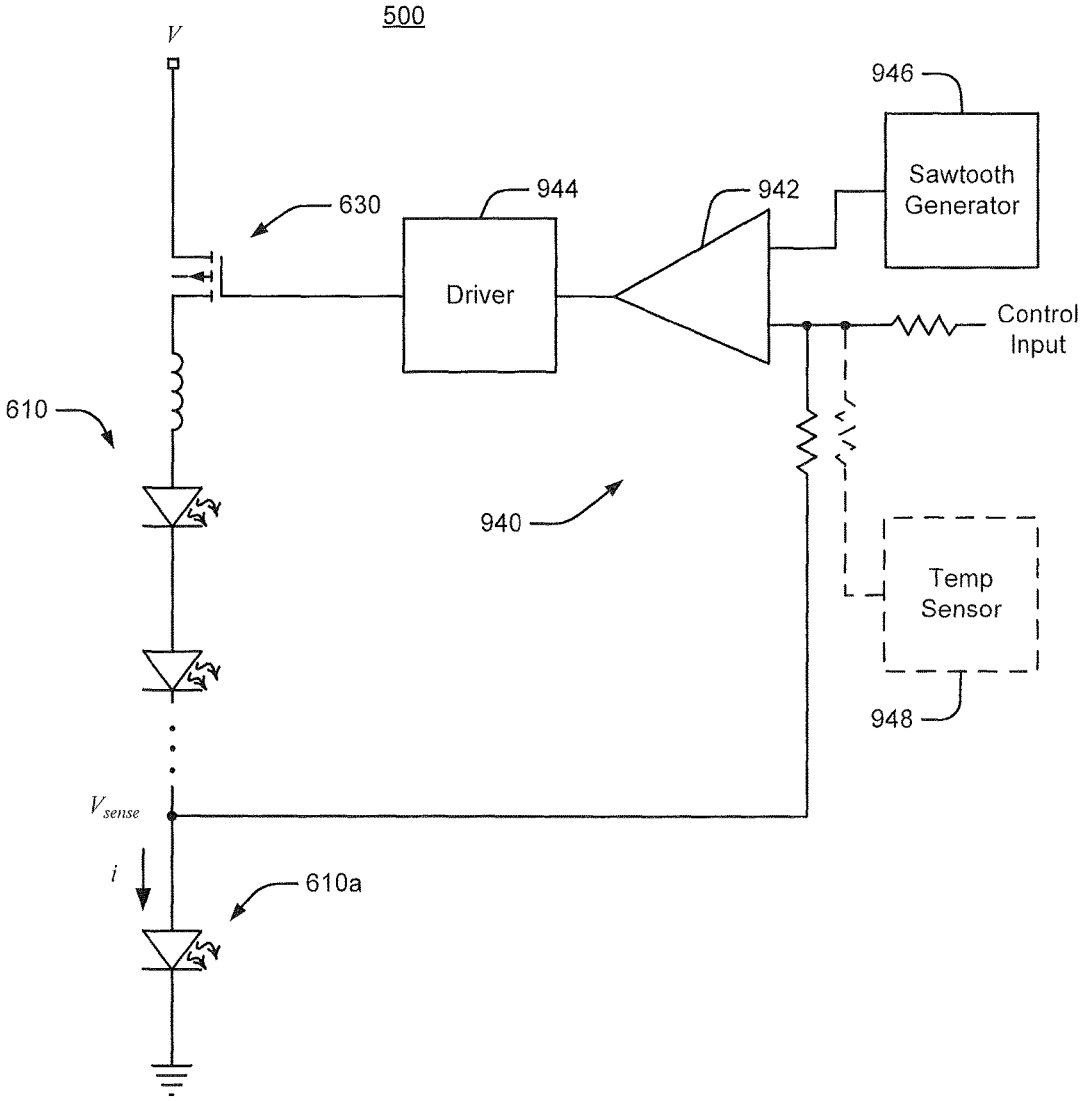
FIG. 9 illustrates a lighting apparatus with analog current control and non-linear current feedback according to some embodiments of the inventive subject matter.

In some embodiments, similar functionality may be provided using analog circuitry instead of a microcontroller. For example, as illustrated in FIG. 9, a lighting apparatus 900 may include a control circuit including a comparator circuit 942 that is configured to receive the current feedback signal $V_{sense}$ and a sawtooth signal generated by a sawtooth generator circuit 946. Based on a comparison of the these signals, the comparator circuit generates a PWM signal that is applied to a driver circuit 944 that drives the transistor 630 connected in series with a string 610 of LEDs. As shown, temperature compensation of the current feedback signal $V_{sense}$ may be achieved, for example, by combining the current feedback signal $V_{sense}$ with an output of a temperature sensor 948. It will be appreciated that temperature compensation could be achieved in other ways, such as by varying the output of the sawtooth generator circuit 946 responsive to a temperature sense signal.

According to further embodiments of the inventive subject matter, a diode current sensor may be employed with a controllable bypass circuit that is used to selectively bypass current around one or more LEDs of a string for purposes of, for example, color control. The aforementioned U.S. patent application Ser. No. 12/704,730, entitled "SOLID STATE LIGHTING APPARATUS WITH COMPENSATION BYPASS CIRCUITS AND METHODS OF OPERATION THEREOF," filed Feb. 12, 2010 and incorporated herein by reference in its entirety, describes the use of controllable bypass circuits lighting apparatus. According to some embodiments of the inventive subject matter, such bypass circuits may be modified to utilize non-linear current sensors to provide advantageous performance.

Figure 10:
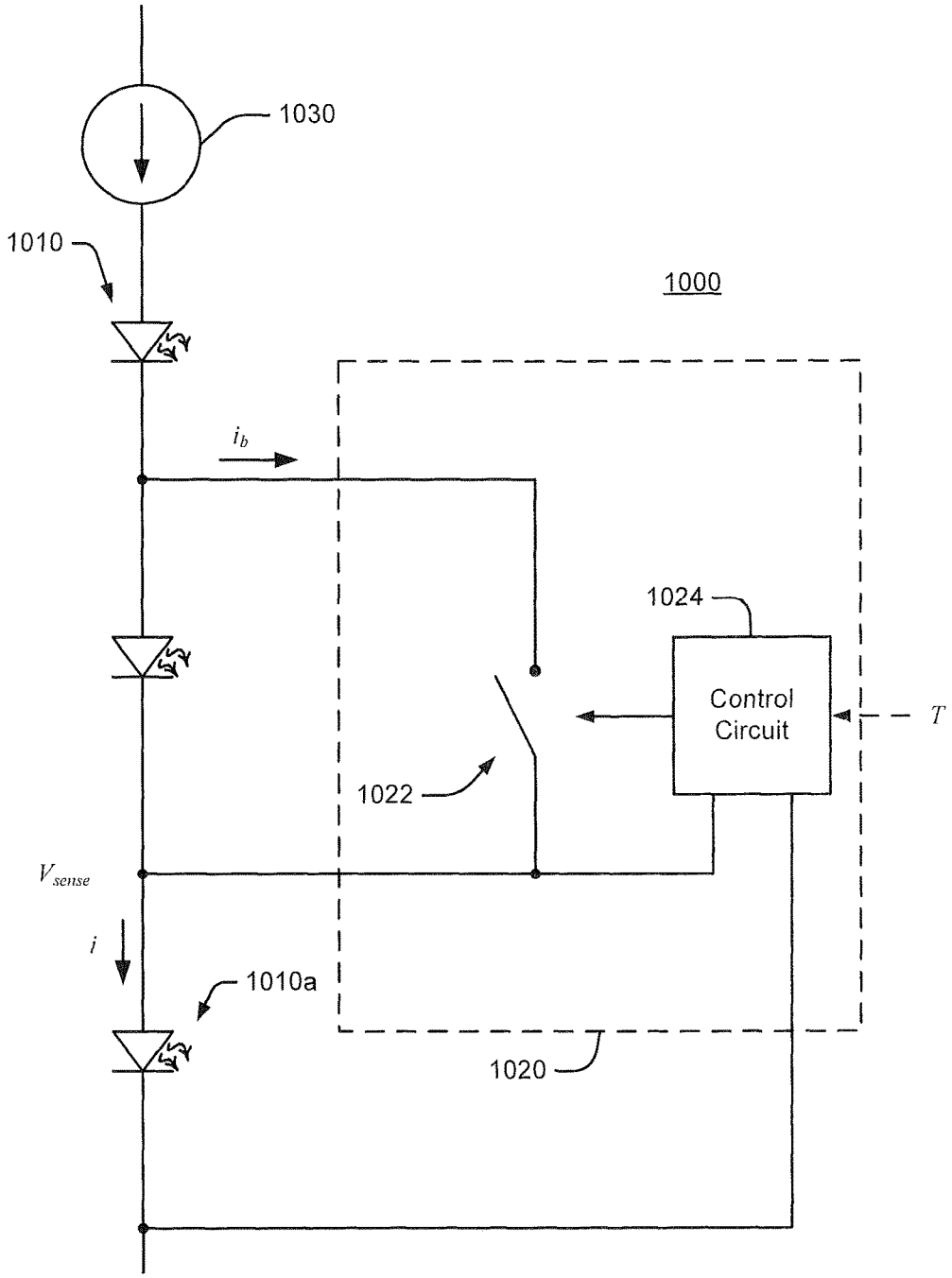
FIG. 10 illustrates a lighting apparatus with a controllable bypass circuit using non-linear current feedback according to some embodiments of the inventive subject matter.

For example, a lighting apparatus 1000 illustrated in FIG. 10 may include a string 1010 of serially-connected LEDs. One LED 1010*a* of the string 1010 may be selectively bypassed by a controllable bypass circuit 1020. As shown, the bypass circuit 1020 may include a switch 1022 and a control circuit 1024 configured to control the switch 1022. The control circuit 1024 may control the switch 1022 responsive to a forward voltage $V_{sense}$ developed across another LED 1010*b* of the string 1010. Thus, for example, in response to variation of a current i supplied to the string 1010 by a current source 1030 (e.g., a dimmer circuit), the bypass circuit 1020 may vary the amount of current $i_b$ bypassed around the bypassed LED 1010*a* in relation to the total string current i. For example, the string 1010 may include LEDs of differing colors, e.g., red and blue-shifted yellow, with the bypassed LED 1010*a* having one of these colors. The controllable bypass circuit 1020 may act to compensate for different light output vs. current characteristics of the different types of diodes in the string 1010 by increasing or decreasing the relative magnitude of the bypass current $i_b$ in relation to the string current i as the string current i varies to maintain a desired color. As shown, the bypass circuit 1020 may also compensate for temperature responsive to a temperature signal T.

Figure 11:
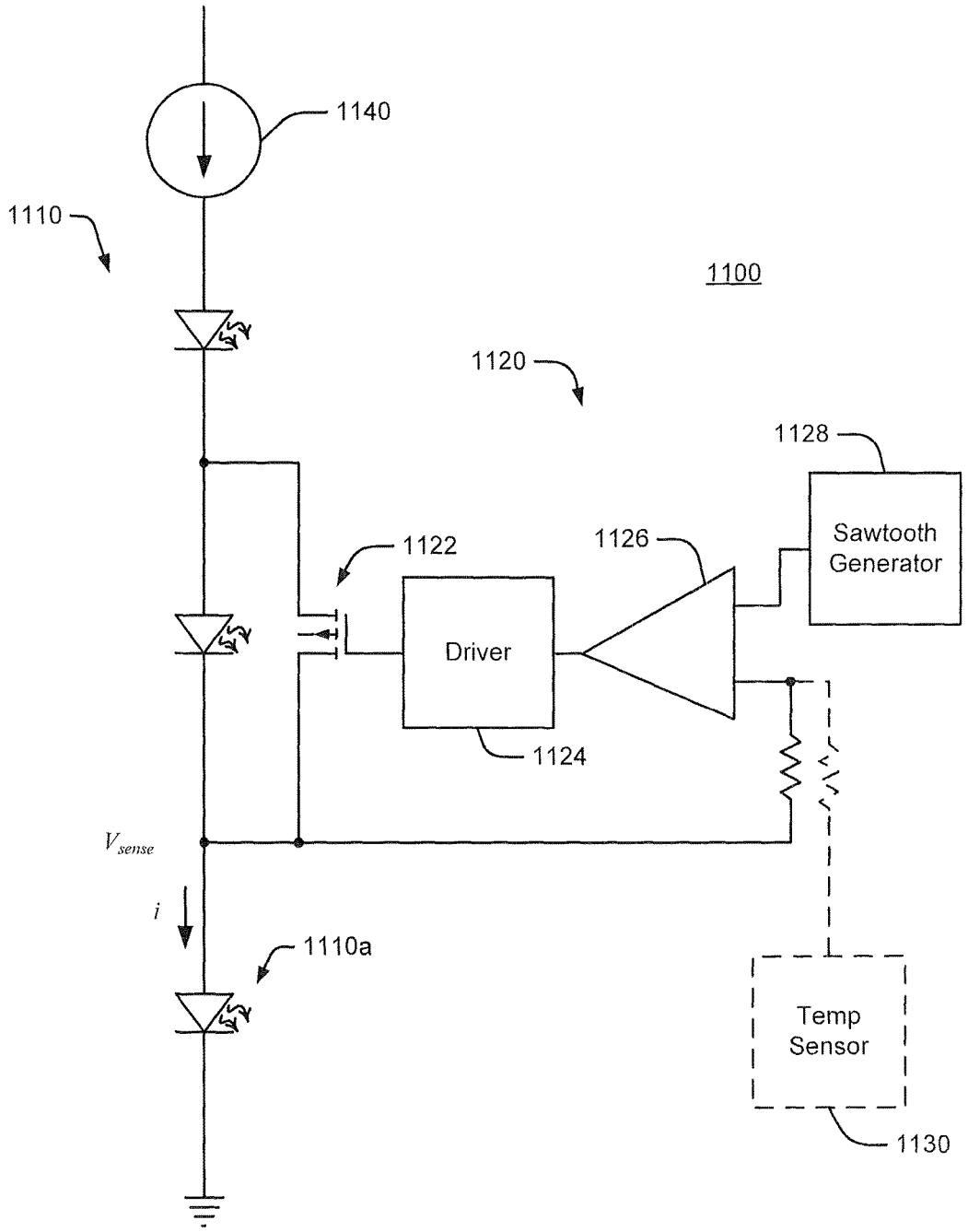
FIG. 11 illustrates a lighting apparatus with a PWM bypass circuit and non-linear current feedback according to some embodiments of the inventive subject matter.

FIG. 11 illustrates a lighting apparatus 1100 with a controllable bypass circuit along such lines. The apparatus 1100 includes a string 1110 of serially-connected LEDs connected to a current source 1140 (e.g., a dimmer circuit) that controls a current i through the string 1110. One LED 1110*a* of the string 1110 may be selectively bypassed by a controllable bypass circuit including a switching transistor 1122 driven by a control circuit including a sawtooth generator 1128 and a comparator 1126 configured to receive a sawtooth signal generated by the sawtooth generator 1128 and a current feedback signal $V_{sense}$ corresponding to a forward voltage developed across another LED 1110*b* of the string 1110. The comparator circuit 1126 controls a driver circuit 1124, producing a PWM signal that drives a gate of the transistor 1122. The comparator circuit 1126 may also operate responsive to a temperature signal generated by a temperature sensor 1130, which may be used to compensate for temperature dependency of the current sensing LED 1110*b*. It will be appreciated that similar functionality may be provided using other types of control circuits, such as microcontroller-based control circuits.

Figure 12:
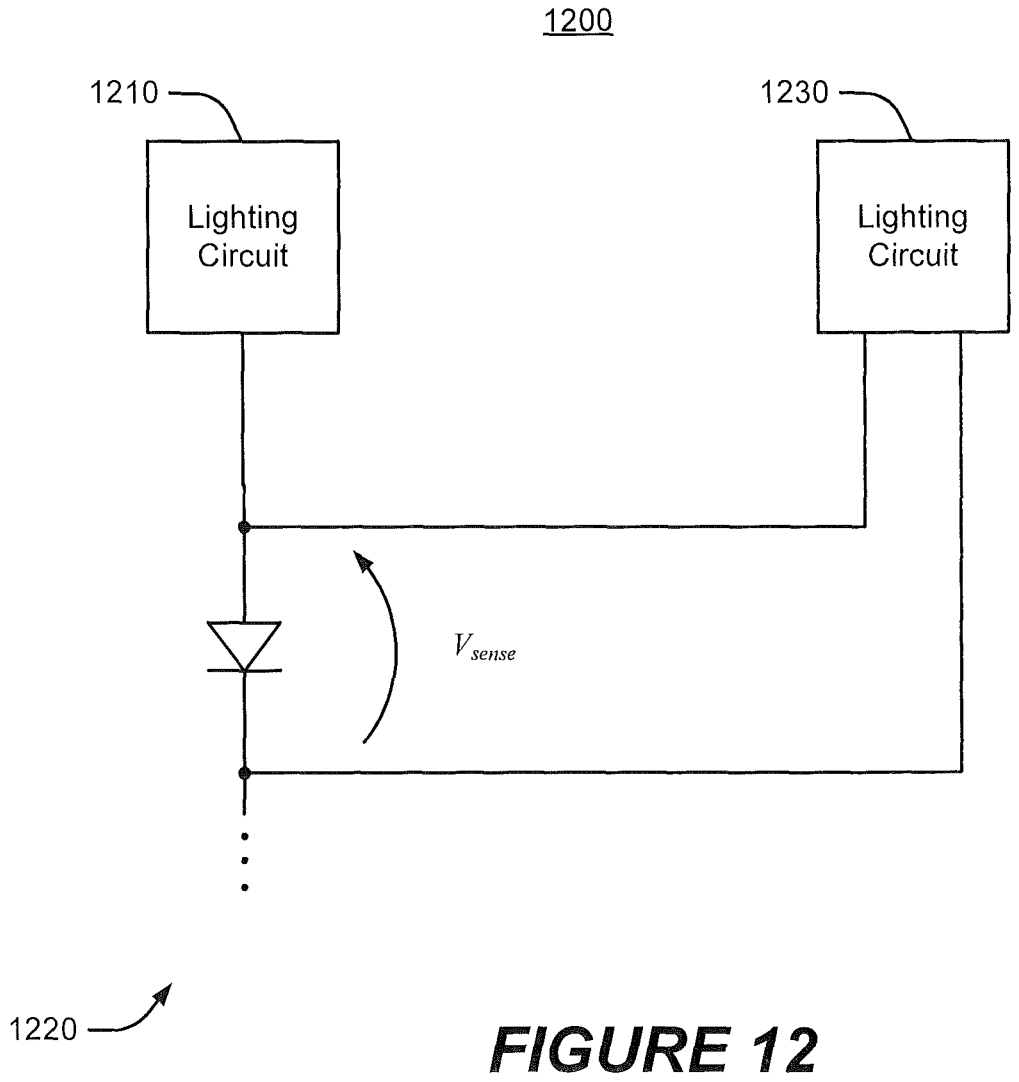
FIG. 12 illustrates a lighting apparatus with non-linear current feedback according to further embodiments of the inventive subject matter.
Figure 13:
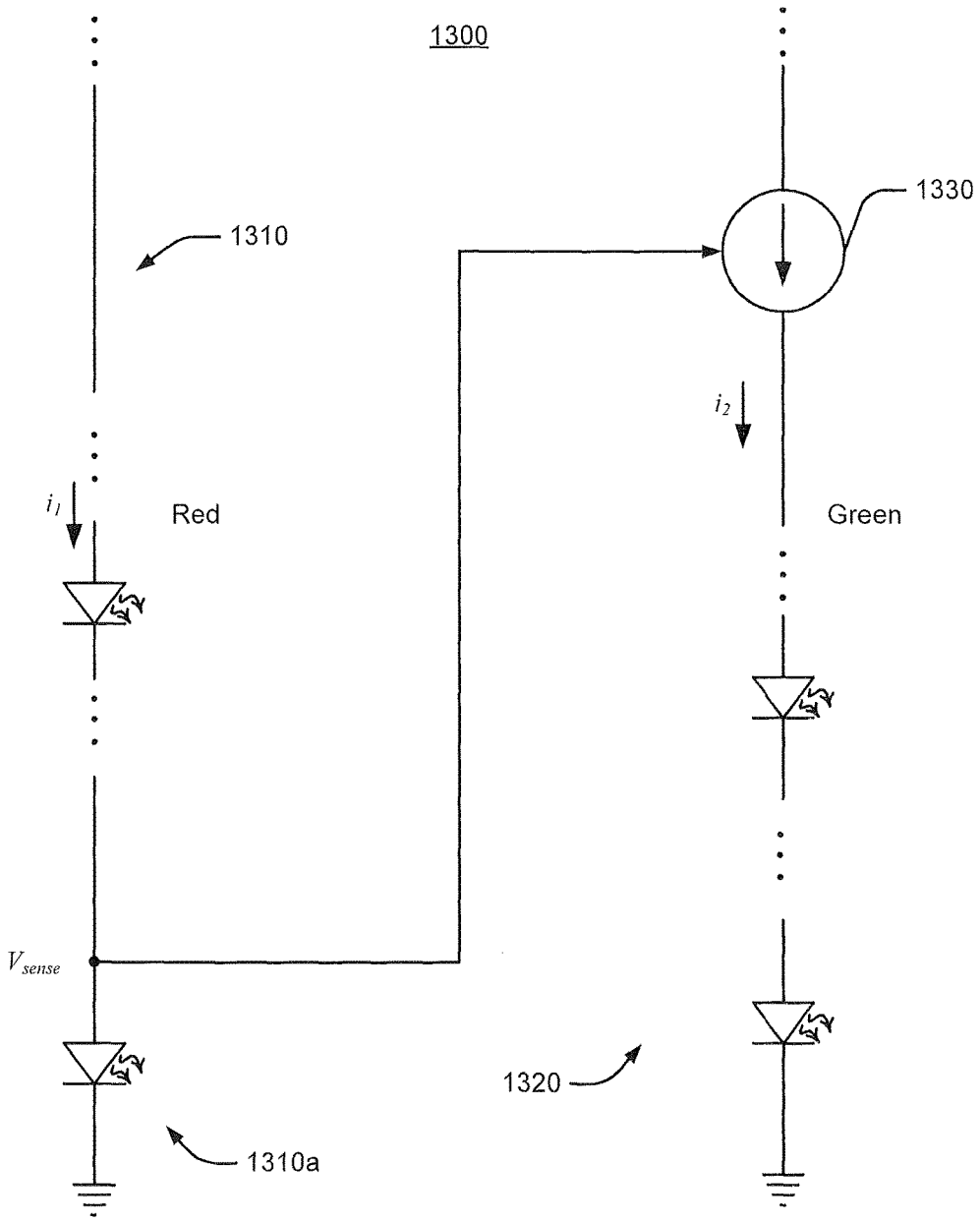
FIG. 13 illustrates an LED lighting apparatus with intra-string current feedback according to some embodiments of the inventive subject matter.

In additional embodiments illustrated in FIG. 12, a current sensing diode 1220 for a first lighting circuit 1210, e.g., a first string of LEDs, may be used to control a second lighting circuit 1230, e.g., a second string of LEDs, such that, for example, a color point of the lighting apparatus 1200 may be maintained. For example, referring to FIG. 13, a lighting apparatus 1300 may include a string 1310 of green LEDs and string 1320 of red LEDs. A forward voltage $V_{sense}$ developed across one of the green LEDs 1310*a* in response to a string current $i_1$ may be used to control a current $i_2$ provided in the second string 1320 by a current source 1330. Thus, for example, as the current $i_1$ in the first string varies, the current $i_2$ in the second string 1320 may vary in a substantially logarithmic fashion in relation to the current $i_1$ in the first string 1310. In this manner, a desired color may be provided.

Figure 14:
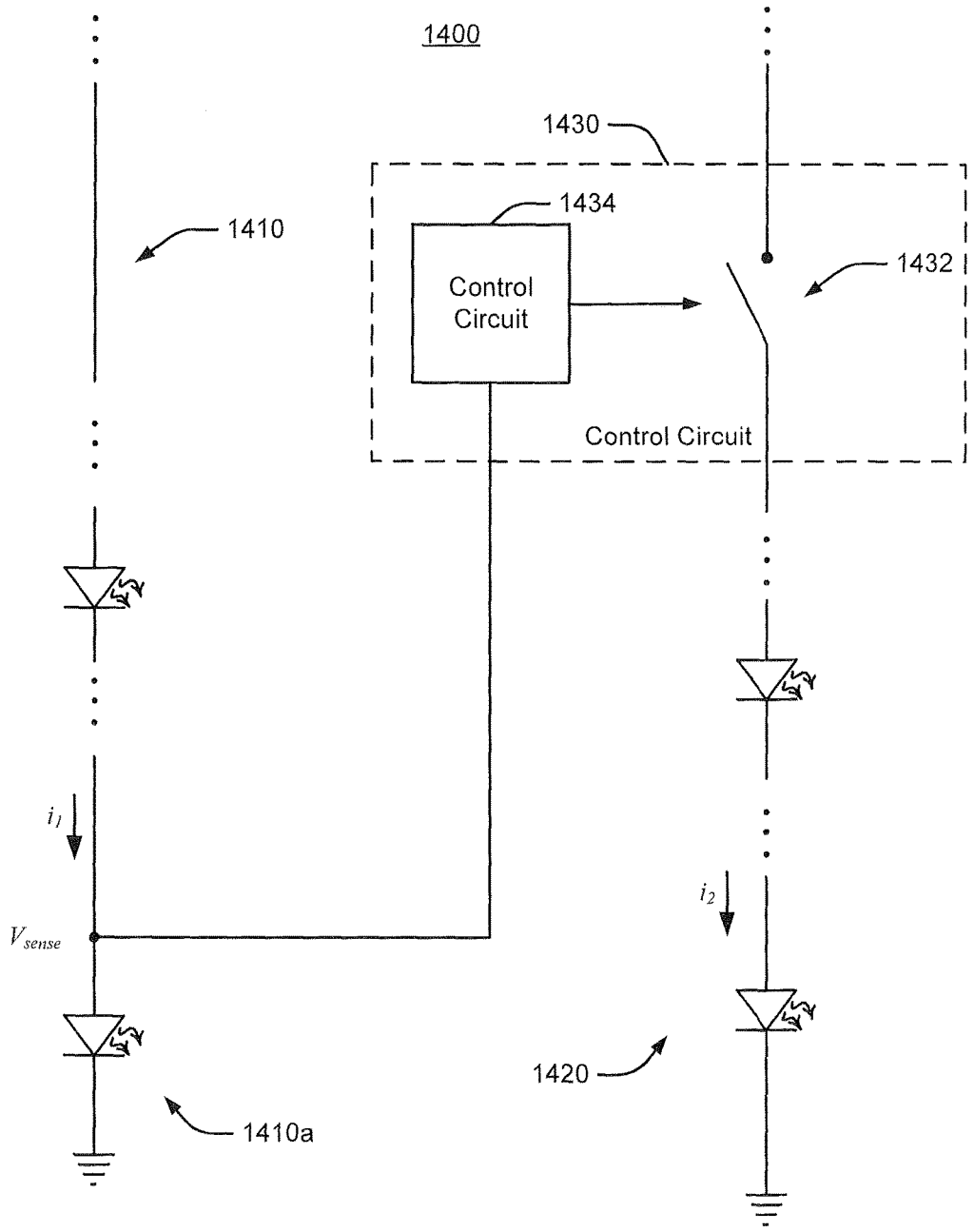
FIG. 14 illustrates an LED lighting apparatus with intra-string current feedback according to further embodiments of the inventive subject matter.

FIG. 14 illustrates an exemplary lighting apparatus 1400 implementing such an approach. A lighting apparatus 1400 includes a first string 1410 of LEDs including a current sensing LED 1410*a*. A second string of LEDs 1420 is connected in series with a current source 1430, which controls a current passing through the second string of LEDs 1420. The current source 1430 includes a control circuit 1434 that controls a switch 1432 connected in series with the second string 1420 of LEDs. The control circuit 1434 opens and closes the switch 1432 responsive to a forward voltage $V_{sense}$ developed across the current-sensing LED 1410*a* of the first string 1410.

Figure 15:
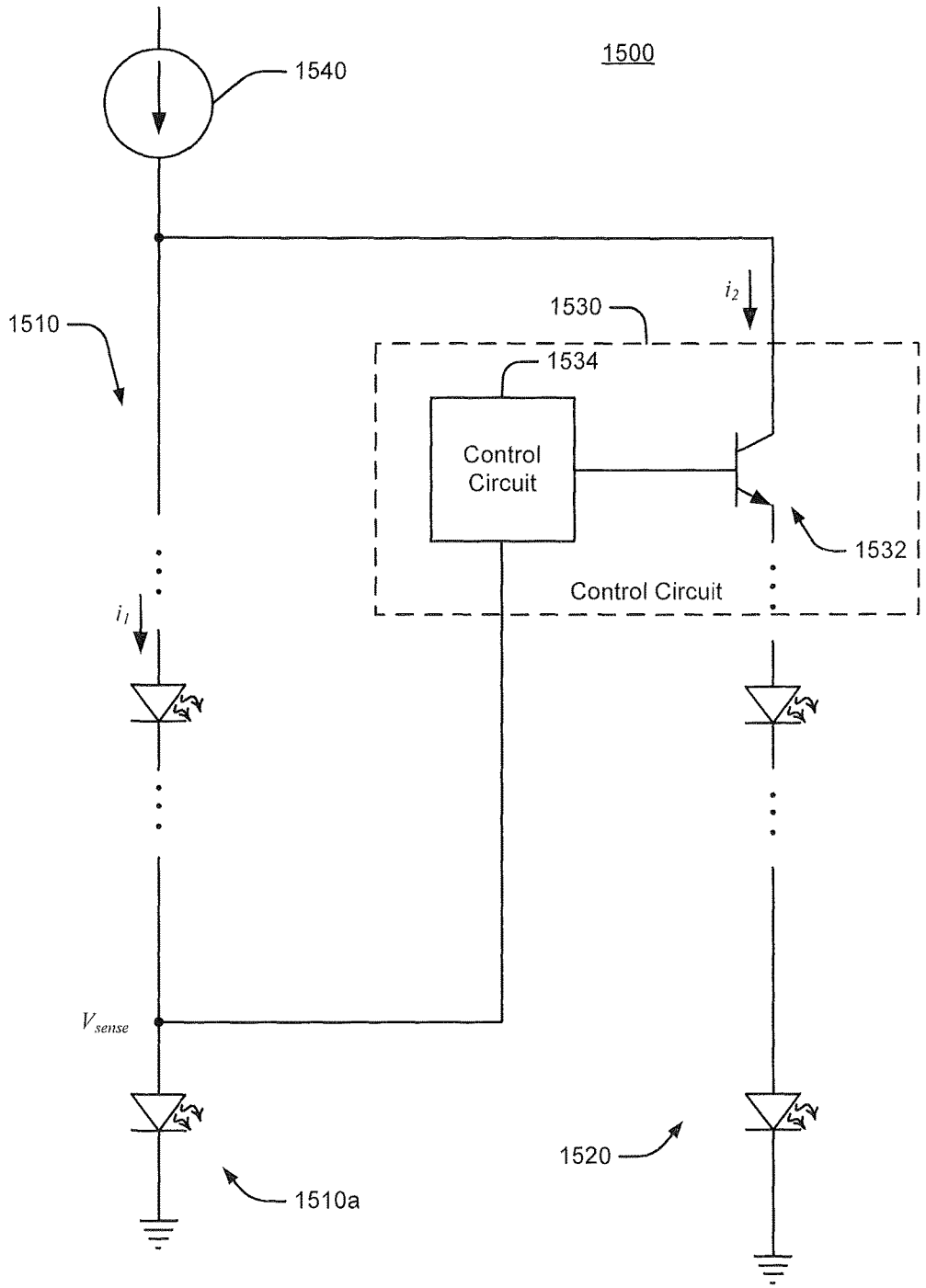
FIG. 15 illustrates a lighting apparatus with current balancing and non-linear current feedback according to some embodiments of the inventive subject matter.

FIG. 15 illustrates a current balancing arrangement according to further embodiments. A lighting apparatus 1500 includes first and second LED strings 1510, 1520 coupled in common to a current source 1540, for example, a dimmer circuit or a luminance calibration circuit. The first and second LED strings 1520, 1520 may include, for example, LEDs of different colors, e.g., red and green, red and blue-shifted yellow, etc. A current controller 1530 coupled in series with the second string of LEDs 1520 includes a bipolar transistor 1532 that is controlled by a control circuit 1534 responsive to a forward voltage $V_{sense}$ developed across a current-sensing LED 1510*a* of the first string 1510. The control circuit 1534 is configured to vary a base potential of the transistor 1532 to control a current passing through a second string of LEDs 1520, i.e., the transistor 1532 is operated as a variable resistance. In this manner, a desired color point may be maintained as the current provided by the current source 1540 varies. It will be appreciated that other types of current controlling devices may be used in a similar fashion in other embodiments. For example, a PWM current controller along the lines of the current controller 1430 of FIG. 14 may be similarly used.

Figure 16:
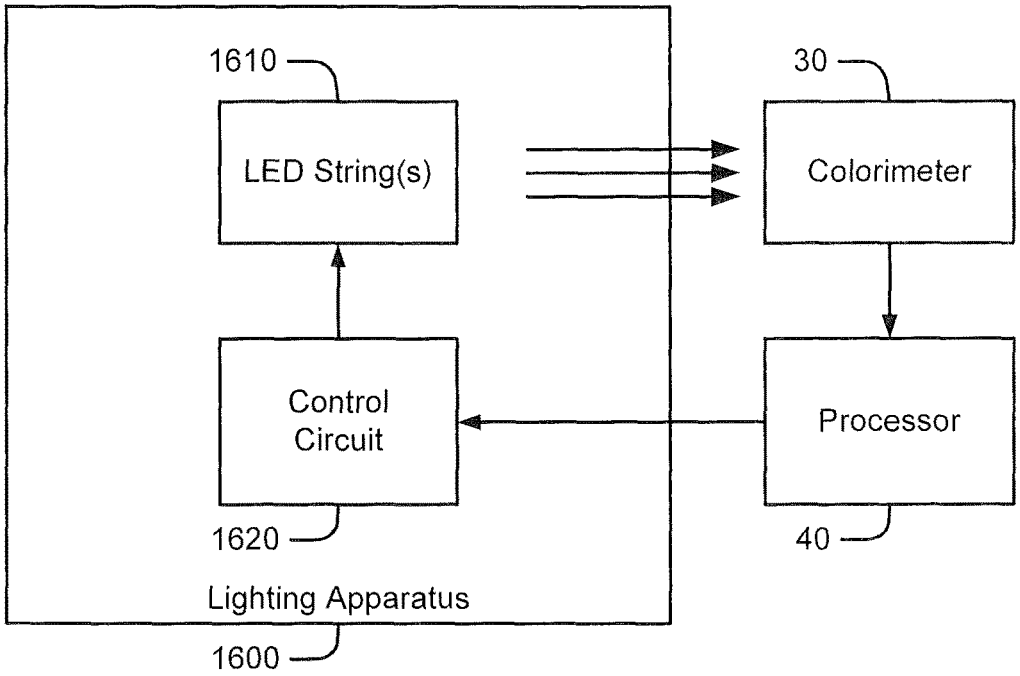

FIG. 16 illustrates apparatus and methods for calibration of a lighting apparatus 1600 according to further embodiments of the inventive subject matter. The lighting apparatus 1600 includes one or more LED strings 1610 and a control circuit 1620 configured to control at least one of the one or more LED strings 1610 responsive to a diode forward voltage associated with a current flowing in one of the LED strings 1610. For example, the control circuit 1620 may control a total current and/or a bypass current as described above with reference to FIGS. 3-15. As shown, the control circuit 1620 is configured to communicate with a processor 40, which may provide adjustment inputs, such as lookup table values and/or polynomial coefficients. Light generated by the one or more LED strings 1620 is detected by a colorimeter 30, for example, a PR-650 SpectraScan® Colorimeter from Photo Research Inc., which can be used to make direct measurements of luminance, CIE Chromaticity (1931 xy and 1976 u'v') and/or correlated color temperature. A luminance and/or color point of the light may be detected by the colorimeter 30 and communicated to the processor 40. In response to the detected characteristics, the processor 40 may input control information needed to enable the control circuit 1620 to provide a desired performance. In various embodiments of the inventive subject matter, such calibration may be done in a factory setting and/or in situ.

In the drawings and specification, there have been disclosed typical embodiments of the inventive subject matter and, although specific terms are employed, they are used in a generic and descriptive sense only and not for purposes of limitation, the scope of the inventive subject matter being set forth in the following claims.

That which is claimed is:

1. A lighting apparatus comprising:

a lighting circuit comprising a first string of serially connected light emitting devices (LEDs) and a second string of serially connected LEDs;

a current control device connected in series with the second string of serially connected LEDs and configured to variably impede a current passing through the second string of serially connected LEDs;

at least one current sense diode coupled in series with the first string of serially connected LEDs and configured to generate a forward voltage responsive to the current passing through the first string of serially connected LEDs; and a control circuit configured to control the current control device responsive to comparison of the forward voltage to a control input, wherein the at least one current sense diode is not in series with the second string of serially connected LEDs, and wherein the current control device is not in series with the first string of serially connected LEDs.

2. The apparatus of claim 1, further comprising a temperature sensor separate from the at least one current sense diode and configured to generate a temperature sense signal, and wherein the control circuit is configured to control the lighting apparatus responsive to the sensed forward voltage and the temperature sense signal.

3. The apparatus of claim 1, wherein the at least one current sense diode comprises at least one LED.

4. The apparatus of claim 1, wherein the at least one current sense diode comprises an LED of the first string of serially connected LEDs.

5. The apparatus of claim 1, wherein the first and second strings of serially connected LEDS comprise LEDs of different colors.

6. The apparatus of claim 1, wherein the first string of serially connected LEDs is connected in parallel with the second string of serially connected LEDs.

7. A lighting apparatus comprising:

a first string of serially connected LEDs;

a second string of serially connected LEDs;

at least one current sense diode connected electrically in series with the first string of serially connected LEDs and not electrically in series with the second string of serially connected LEDs, wherein the at least one current sense diode is configured to generate a forward voltage indicative of a current passing through the first string of serially connected LEDs;

a current control device connected electrically in series with the second string of serially connected LEDs and not electrically in series with the first string of serially connected LEDs, wherein the current control device is configured to variably impede the current passing through the second string of serially connected LEDs; and a control circuit configured to sense the forward voltage and to control the current control device responsive to the sensed forward voltage.

8. The apparatus of claim 7, wherein the at least one current sense diode comprises at least one LED of the first string of serially connected LEDs.

9. The apparatus of claim 7, wherein the first string of serially connected LEDs is connected in parallel with the second string of serially connected LEDs.

10. A method of controlling a lighting circuit comprising a first string of serially connected light emitting devices (LEDs) and a second string of serially connected LEDs, the method comprising:

generating a forward voltage across at least one current sense diode connected in series with the first string of serially connected LEDs responsive to a current passing through the first string of serially connected LEDs;

sensing the forward voltage; and controlling a current control device connected in series with the second string of serially connected LEDs to variably impede the current passing through the second string of serially connected LEDs responsive to a comparison of the sensed forward voltage to a control input, wherein the at least one current sense diode is not in series with the second string of serially connected LEDs, and wherein the current control device is not in series with the first string of serially connected LEDs.

11. The method of claim 10, wherein the first string of serially connected LEDs comprises the at least one current sense diode.

12. The method of claim 10, wherein the at least one current sense diode comprises at least one LED.

13. The method of claim 10, wherein the at least one current sense diode comprises an LED of the first string of serially connected LEDs.

14. The method of claim 10, wherein the first string of serially connected LEDs is connected in parallel with the second string of serially connected LEDs.

15. A lighting apparatus comprising:

a first string of serially connected LEDs;

a second string of serially connected LEDs;

at least one current sense diode connected electrically in series with the first string of serially connected LEDs and not electrically in series with the second string of serially connected LEDs;

a current control device connected electrically in series with the second string of serially connected LEDs and not electrically in series with the first string of serially connected LEDs, wherein the current control device is configured to variably impede a current passing through the second string of serially connected LEDs; and a control circuit configured to sense a forward voltage across the at least one current sense diode and to control the current control device responsive to the forward voltage across the at least one current sense diode.

16. The apparatus of claim 15, wherein the first and second strings of serially connected LEDs comprise LEDs of different colors.

17. The apparatus of claim 15, wherein the first and second strings of serially connected LEDs are not connected electrically in series with one another.

* * * * *